United States Patent [19]

Depa

[11] Patent Number: 4,702,166

[45] Date of Patent: Oct. 27, 1987

[54] PLATE LOCK-UP MECHANISM FOR PRINTING PRESSES

[75] Inventor: Louis S. Depa, Downers Grove, Ill.

[73] Assignee: Rockwell International Corporation, Pittsburgh, Pa.

[21] Appl. No.: 901,237

[22] Filed: Aug. 28, 1986

[51] Int. Cl.[4] ..... B41F 27/06; B41F 27/12

[52] U.S. Cl. ..... 101/415.1

[58] Field of Search ..... 101/415.1, 378; 51/368

[56] References Cited

U.S. PATENT DOCUMENTS

| | | | |
|---|---|---|---|
| 3,022,728 | 2/1962 | Heller | 101/415.1 |
| 3,382,799 | 5/1968 | Luehrs | 101/415.1 |
| 3,727,551 | 4/1973 | Kostas et al. | 101/415.1 |
| 4,495,865 | 1/1985 | Kamoda | 101/415.1 |
| 4,584,942 | 4/1986 | Sauer | 101/415.1 |

FOREIGN PATENT DOCUMENTS

| | | | |
|---|---|---|---|
| 1034508 | 6/1956 | Fed. Rep. of Germany | 51/368 |

*Primary Examiner*—J. Reed Fisher

[57] ABSTRACT

A printing press cylinder having an improved plate lock-up which comprises a locking bar that is disposed within an undercut slot in the cylinder, which bar grips the end of the plate and can be turned and locked in position to keep the plate solidly agaunt the cylinder and form a very narrow non-print gap.

2 Claims, 4 Drawing Figures

PLATE LOCK-UP MECHANISM FOR PRINTING PRESSES

FIELD OF THE INVENTION

This invention relates to printing cylinders and more particularly to a cylinder having a printing plate lock-up mechanism that holds the plate tightly against the surface of the printing cylinder throughout its length and permits the use of a very narrow non-print gap.

BACKGROUND OF THE INVENTION

In offset lithographic printing the image to be printed is carried on a thin flexible planographic plate that is wrapped around and secured to the plate cylinder at both its leading and trailing ends. The leading end is normally bent rearwardly to form an acute angle between the bent portion and the remainder of the plate and then hooked onto an undercut edge formed in the plate cylinder. In the past, the trailing end of the plate was usually also bent and then locked into the same undercut area as the leading end, by some sort of lock-up mechanism.

For example, in U.S. Pat. No. 3,727,551 the trailing end of the plate is formed with a U-shaped bend and is engaged by a gripper carried within a rockable bar that is disposed within an undercut slot formed in the plate cylinder. In U.S. Pat. No. 3,757,690 the leading end is again hooked over an undercut edge while the trailing end is held within a rotatable rod in a groove in the plate cylinder by means of a separate clamping block. Additional examples of existing plate lock-up mechanisms can be found in U.S. Pat. No. 3,260,200; 4,347,788 and 4,495,865.

For a plate lock-up mechanism to be effective it must conform the plate to the surface of the plate cylinder solidly to lengthen the useful life of the plate and reduce plate cracking. Cracking would occur under conditions where the plate is not solidly against the cylinder and is thus able to flex during printing operations. One factor that has become important in modern lithographic printing is that of reducing the width of the non-print gap that exists between the two undercut edges on the plate cylinder. As printing costs have increased there has been increased emphasis on utilizing the maximum amount of newsprint. That is, when the non-print gap is wide a great deal of newsprint is effectively lost and this fact increases publishing costs.

SUMMARY OF THE INVENTION

It is therefore a principal object of this invention to provide an improved plate lock-up mechanism for printing presses that maintains the plate in solid, tensioned contact with the plate cylinder.

It is an additional object of this invention to provide an improved plate lock-up mechanism which is of simple construction and can be used to tension the plate regardless of the direction of plate rotation.

It is a further object of this invention to provide an improved plate lock-up mechanism which permits a very narrow non-print gap area on the surface of the plate roll.

It is still another object of this invention to provide an improved plate lock-up mechanism that reduces the severity of the bends required in the plate to effect lock-up.

Additional objects and advantages of this invention will be in part obvious and in part explained by reference to the accompanying specification and drawings in which:

DESCRIPTION OF THE INVENTION

Figure 1:
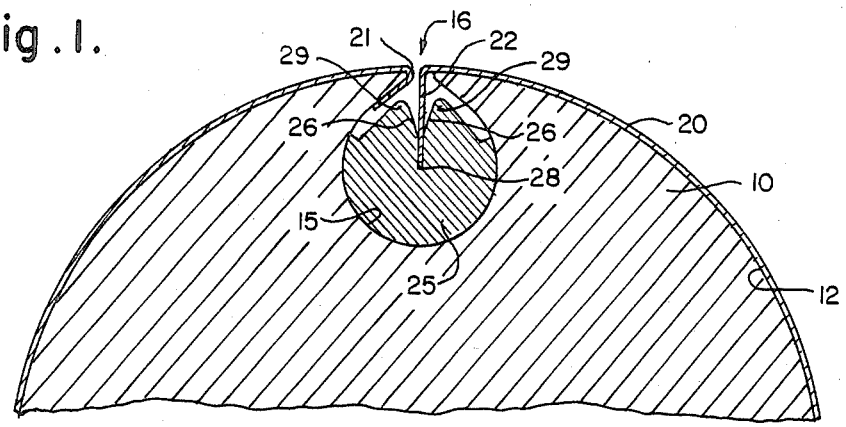
FIG. 1 is a cross-sectional view through a portion of the plate roll showing the locking shaft mounted in a slot in the plate which shows the shaft in position for plate mounting.

Turning now to the drawings, a plate cylinder indicated by the numeral 10 has ends 11 (only one being shown) and an outer surface 12. The cylinder is journalled for rotation on stub shafts 13 which are fitted in suitable journals in the press frame. Formed in the surface of the cylinder is a longitudinally extending slot 15 (see FIGS. 1 and 2) which is of substantially circular cross section and extends across the width of plate cylinder 10. As can be seen from the drawings, the slot 15 has undercut edges and defines a narrow gap 16 in the surface of plate cylinder 10. The geometry of this construction is such that the gap or slot 15 is very narrow so that the non-printing area present on the cylinder is minimal. Mounted upon the plate cylinder 10 is a thin flexible printing plate 20 which has its leading end 21 bent back at an acute angle with respect to itself to form a hook like portion that fits around one of the undercut edges formed in the plate cylinder. The bent portion is designed to extend into the slot 15. The trailing end of the plate cylinder, 22, is bent and placed downwardly through the gap 16 into the interior of slot 15.

Disposed within the longitudinal slot 15 is a rotatable locking shaft 25. The locking shaft 25 includes walls 26 that extend generally radially inwardly and define an opening 27 into which the trailing end of plate 20 can be inserted. The end of the opening terminates in a slot portion 28 which is of a constant thickness that is slightly greater than the thickness of the printing plate 20. Means which are provided on each side of the outer end of the radially extending opening defined by walls 26, to define rounded locking edges 29 about which the plate is bent when rotatable shaft 15 is moved to the locking position. Generally, the means just described define lobes that are equidistantly spaced from each other on each side of the center line of the radially extending opening defined by slot 28 and wall portions 26. It should be noted that the walls 26 causes, the inwardly extending opening to increase uniformly in width from the outer end of the slot portion 28 to its termination at the rounded locking edges 29. The provision of lobes or locking edges 29 equidistantly spaced to define the lateral parameter of opening 27 permits shaft 15 to be rotated in both directions to effect the locking operation.

Figure 3:
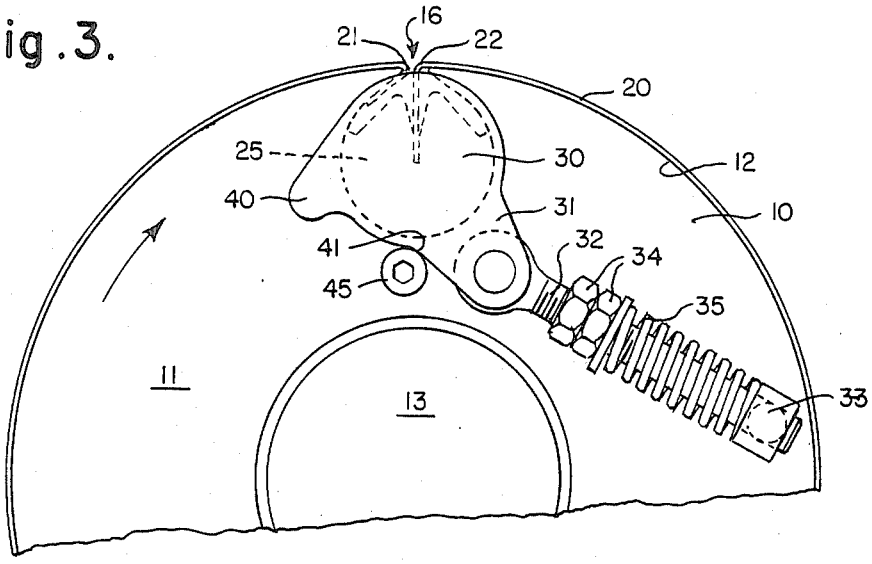
FIG. 3 is an end elevation of a plate roll showing the locking bar actuating mechanism in position for plate mounting.
Figure 4:
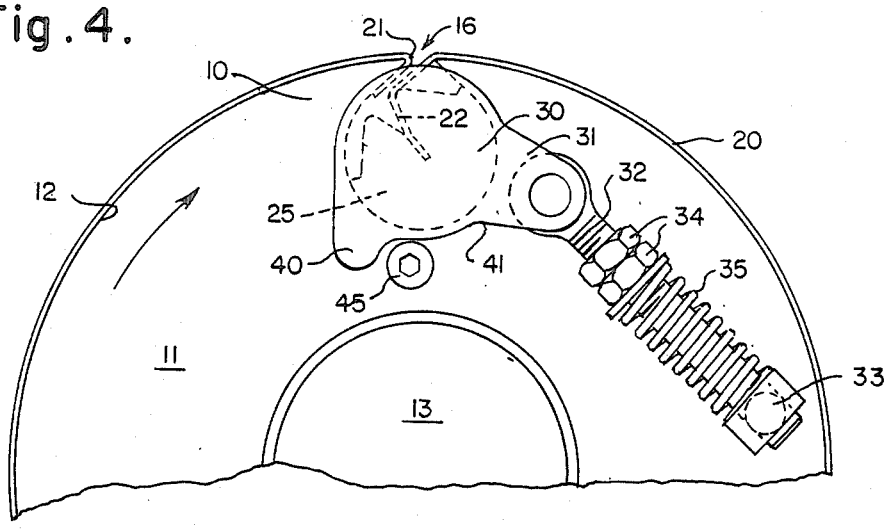
FIG. 4 is a view similar to FIG. 3 but showing the locking bar actuating mechanism in position for locking the plate onto the plate cylinder.

Means, as best seen in FIGS. 3 and 4, for rotating the rockable shaft 25 comprises a fitting 30 that has a crank arm 31 to which is connected a rod 32. The other end of rod 32 is received by a poppit 33 that permits both axial and arcuate movement of the rod 32. Adjusting nuts 34 and a compression spring 35 are also mounted on rod 32 so that the tension exerted against the lever arm 31 can be adjusted as desired.

The fitting 30, which is secured to the end of the rockable shaft 25, also comprises a stop abutment 40 and a stop shoulder 41 (as best seen in FIG. 3) for limiting the arcuate movement of the fitting 30 and thereby the arcuate movement of locking bar 25.

Figure 2:
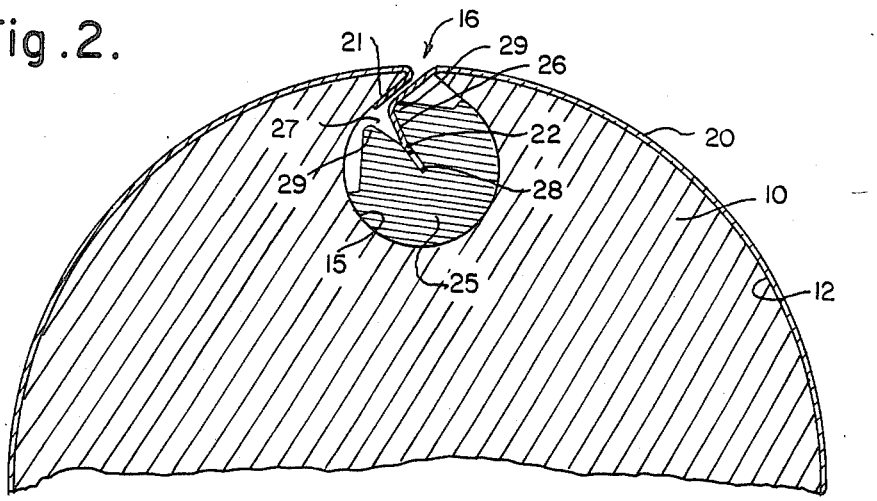
FIG. 2 is a view similar to FIG. 1 but showing the locking shaft in locking position.

When it is desired to secure a plate 20 to roll 10 the locking bar 25 is placed in the position illustrated in FIG. 1 with the radially extending opening directed upwardly toward the gap 15. The hooked end 21 of plate 20 is then secured around the undercut edge, the plate wrapped around the cylinder and the trailing end inserted into the opening formed by walls 26 and on into the more tightly receiving slot portion 27. At this point the rod 32 is moved in an anti-clockwise position until the abutment 40 hits the stop pin 45. At this point the plate will have been drawn into the position shown in FIG. 2 where it is tightly and solidly drawn against the outer surface 12 of the cylinder.

While only a single embodiment of the present invention has been shown and described, it will be obvious to those skilled in the art that many changes and modifications may be made without departing from the spirit and scope of the invention.

What is claimed is:

1. In a printing press plate lockup for holding a flexible printing plate having a first hooded end and a second end, the combination comprising:

(a) a plate cylinder defining a longitudinal slot of substantially circular cross section extending across the width of said plate cylinder, said slot having undercut edges defining a narrow gap in the surface of said plate cylinder;

(b) a rotatable locking shaft mounted in the slot, said locking shaft having:

(i) outwardly extending lobes having walls defining a generally radially inwardly extending opening which terminates in a slot portion having a constant thickness slightly greater than the thickness of the printing plate; said lobes being equidistantly spaced from each other on each side of the centerline of said radially extending opening and having rounded locking edges, wherein said lobes are defined on one side by said walls defining said radially extending slot and on the other side by walls that are relieved from the outer surface of said shaft whereby said locking edges are located radially nearer the center of said locking shaft than is the outer surface of said locking shaft;

(c) means for rotating said shaft between locking and non-locking positions and holding the plate under tension when in the locked position.

2. A printing press lockup as defined in claim 1 wherein said radially inwardly extending opening increases uniformly in width from the outer end of said slot portion and terminates at the rounded locking edges.

* * * * *